US011771193B2

(12) United States Patent
Vic et al.

(10) Patent No.: US 11,771,193 B2
(45) Date of Patent: Oct. 3, 2023

(54) HAIR TREATMENT DEVICE

(71) Applicant: L'OREAL, Paris (FR)

(72) Inventors: Gabin Vic, Saint-Ouen (FR); Maryse Chaisy, Saint-Ouen (FR); Stefania Nuzzo, Saint-Ouen (FR)

(73) Assignee: L'OREAL, Paris (FR)

( * ) Notice: Subject to any disclaimer, the term of this patent is extended or adjusted under 35 U.S.C. 154(b) by 892 days.

(21) Appl. No.: 16/485,346

(22) PCT Filed: Feb. 12, 2018

(86) PCT No.: PCT/EP2018/053387
§ 371 (c)(1),
(2) Date: Aug. 12, 2019

(87) PCT Pub. No.: WO2018/146291
PCT Pub. Date: Aug. 16, 2018

(65) Prior Publication Data

US 2019/0374000 A1 Dec. 12, 2019

(30) Foreign Application Priority Data

Feb. 13, 2017 (FR) ..... 17 51169

(51) Int. Cl.
*A45D 2/24* (2006.01)
*A45D 4/12* (2006.01)
*A45D 20/52* (2006.01)

(52) U.S. Cl.
CPC ..... *A45D 2/2457* (2013.01); *A45D 2/2471* (2013.01); *A45D 4/12* (2013.01); *A45D 20/525* (2013.01); *A45D 2200/205* (2013.01)

(58) Field of Classification Search
CPC . A45D 2/10; A45D 2/143; A45D 2/24; A45D 2/245; A45D 2/2457; A45D 2/28;
(Continued)

(56) References Cited

U.S. PATENT DOCUMENTS 1,490,607 A * 4/1924 Francke ..... A45D 2/2407 132/234
2,052,352 A * 8/1936 Fritz ..... A45D 2/367 132/229

(Continued)

FOREIGN PATENT DOCUMENTS

AU 66467/96 3/1997
CH 541 304 10/1973

(Continued)

OTHER PUBLICATIONS

International Search Report dated Apr. 17, 2018 in PCT/EP2018/053387 filed on Feb. 12, 2018.

(Continued)

*Primary Examiner* — Nicholas D Lucchesi
*Assistant Examiner* — Jennifer Gill
(74) *Attorney, Agent, or Firm* — Oblon, McClelland, Maier & Neustadt, L.L.P.

(57) ABSTRACT

A device for treating at least one lock of hair, comprising: —at least one device (20) for applying mechanical stress to the hair, having a reception surface intended to receive the lock of hair, this surface being greater in width L in a direction perpendicular to said lock, —a microwave-proof chamber which is configured so as to receive the mechanical-stress-application device (20) and at least one part of the hair to be treated, —a microwave emission antenna (30) placed inside the chamber, this antenna extending axially over a distance D at least equal to L/2.

8 Claims, 5 Drawing Sheets

(58) Field of Classification Search
CPC . A45D 2/30; A45D 2/367; A45D 4/12; A61N 5/022
See application file for complete search history.

(56) References Cited

U.S. PATENT DOCUMENTS

| | | | | |
|---|---|---|---|---|
| 3,958,340 | A | 5/1976 | Meyers | |
| 4,710,609 | A | 12/1987 | Switlicki | |
| 4,743,726 | A | 5/1988 | Hughes et al. | |
| 4,749,732 | A | 6/1988 | Kohl et al. | |
| 4,952,360 | A | 4/1990 | Gibbon | |
| 4,922,180 | A * | 5/1990 | Saffer | H01Q 11/08 333/24 R |
| 5,030,820 | A | 7/1991 | Gibbon | |
| 5,286,949 | A | 2/1994 | Simons | |
| 5,494,598 | A | 2/1996 | Hughes | |
| 5,573,016 | A | 11/1996 | Graves | |
| 5,676,871 | A | 10/1997 | Graves | |
| 5,683,382 | A * | 11/1997 | Lenihan | A61B 18/18 607/101 |
| 5,773,802 | A | 6/1998 | Graves | |
| 5,819,763 | A | 10/1998 | Hallowell, II | |
| 5,988,182 | A | 11/1999 | Engelbrecht | |
| 6,079,422 | A | 6/2000 | Drago et al. | |
| 6,352,080 | B1 | 3/2002 | Neville | |
| 9,775,419 | B2 * | 10/2017 | Genain | A45D 7/06 |
| 2004/0127895 | A1 * | 7/2004 | Flock | A61L 24/001 606/41 |
| 2004/0250830 | A1 | 12/2004 | Mackinder | |
| 2006/0042649 | A1 | 3/2006 | Anzevino | |
| 2006/0108358 | A1 | 5/2006 | Bell | |
| 2007/0056960 | A1 * | 3/2007 | Bell | A45D 2/36 219/678 |
| 2010/0006116 | A1 | 1/2010 | Bell | |
| 2010/0137857 | A1 * | 6/2010 | Shroff | A61B 18/1815 606/33 |
| 2011/0218527 | A1 * | 9/2011 | Prakash | A61B 18/16 606/41 |
| 2013/0152959 | A1 | 6/2013 | Genain et al. | |
| 2014/0230842 | A1 * | 8/2014 | Parris | A45D 7/06 132/229 |

FOREIGN PATENT DOCUMENTS

| | | | |
|---|---|---|---|
| DE | 31 48 538 | A1 | 6/1983 |
| EP | 0 197 824 | | 10/1986 |
| EP | 0 295 780 | A1 | 12/1988 |
| FR | 1.530.369 | | 6/1968 |
| FR | 2.114.540 | | 6/1972 |
| FR | 2.118.945 | | 8/1972 |
| FR | 2.178.049 | | 11/1973 |
| FR | 2 470 596 | | 6/1981 |
| FR | 2 472 382 | | 7/1981 |
| FR | 2 495 931 | | 6/1982 |
| FR | 2 535 730 | | 5/1984 |
| FR | 2 598 613 | A1 | 11/1987 |
| FR | 2 679 448 | A1 | 1/1993 |
| FR | 2 959 917 | | 11/2011 |
| GB | 2 197 352 | A | 11/1986 |
| JP | 9-51813 | A | 2/1997 |
| JP | 9-75125 | A | 3/1997 |
| KR | 20060134509 | * | 12/2006 |
| LU | 83703 | | 6/1983 |
| WO | WO 90/14780 | A1 | 12/1990 |
| WO | WO 02/051281 | A2 | 7/2002 |
| WO | WO 02/100210 | A2 | 12/2002 |

OTHER PUBLICATIONS

French Preliminary Search Report dated Jul. 7, 2017 in French Application 17 51169 filed on Feb. 13, 2017.

* cited by examiner

HAIR TREATMENT DEVICE

The present invention relates to hair treatment processes and devices.

BACKGROUND

Cosmetic treatments for long-lasting shaping of the hair are mainly performed using chemical products.

Two techniques, both based on cleavage of the —S—S— disulfide bonds present in keratin (cystine) are generally used for obtaining permanent reshaping of the hair.

The first technique includes a first step that consists in opening the disulfide bonds using a composition comprising a reducing agent, for example of thioglycolic acid type. This first reduction step is generally performed at a pH of between 8 and 9.

This first technique then involves, preferably after rinsing the hair, a second step that consists in reconstituting the disulfide bonds by applying to the hair an oxidizing composition known as a fixer. The hair may, prior to the application of the reducing composition, be placed under stress by suitable devices such as curlers, or be straightened out. The oxidation step maybe performed at a pH of about 3 and may facilitate the formation of new disulfide bridges enabling the head of hair to be held in the desired shape.

The second technique involves a step of lanthionization using a composition comprising a base belonging to the family of hydroxides. The lanthionization step is generally performed at a basic pH of about 13. Lanthionization is the conversion of the disulfide bridges into monosulfide bridges. This type of treatment is mainly used for shaping naturally frizzy hair.

In order to obtain satisfactory performance in terms of durability of shaping, the compositions used in the treatments known in the prior art may comprise relatively high concentrations of chemical active agents (for example reducing agents or hydroxide compounds). Thus, thioglycolic acid may be used in certain compositions, at mass concentrations of between 6% and 11%, and sodium hydroxide at 2%.

Products comprising thioglycolic acid have an unpleasant odor, which may be present during the application and may also persist on the hair once the treatment has been performed.

In addition, the treatments described above may lead to irreversible degradation of the hair induced by changes in the intrinsic properties of the hair fiber.

These treatments may also, if they are not performed correctly, irritate the scalp due to their relatively high concentration of chemical active agents.

There is therefore a need to activate these processes in order to reduce the contact time with the chemical reagents and/or to enable a decrease in their concentrations.

It is thus a known practice to supply heat during the treatment in order to activate these processes. The known techniques for providing heat may make it possible to improve the cosmetic performance qualities, but always involve high concentrations of chemical active agents and may thus have the same drawbacks as the treatments described above.

Documents WO 2002/051 281, US 2006/0 042 649, US 2004/0 250 830, WO 2002/100 210, US 2000/680 432, U.S. Pat. Nos. 6,079,422, 5,988,182, 5,819,763, 5,773,802, 5,676,871, JP 09075125, JP 09051813, AU 9664467, U.S. Pat. No. 5,494,598, EP 197 824, U.S. Pat. Nos. 4,710,609, 4,743,726, 4,952,360, 5,030,820 and 5,286,949 describe objects, for example curlers, which may be heated in a household microwave oven and then used on for drying thereof and hairsetting.

U.S. Pat. No. 3,958,340 describes a process for the rapid drying of wigs using air heated by microwave radiation.

Patent CH 541 304 describes a hair-treatment device comprising a substantially electromagnetically closed resonator enclosing a lock-supporting surface and a coupling component or adaptor within the resonator. The resonator is connected to a generator of high frequency alternating current by a transmission line connected to the coupling component, the latter matching the characteristics of the resonator to those of the generator and the transmission line.

FR 2 118 945 discloses a hair-treatment device comprising a substantially electromagnetically closed envelope forming a resonator and means for producing the high frequency energy dissipated in said resonator. Electrical coils for introducing the high frequency electromagnetic energy produced into the electromagnetically closed envelope are carried by a core made of an insulating material and a lock of hair to be treated is wound around the core. The resonator may comprise a coupling element at its centre.

Patent application US 2007/0 056 960 describes a shaping tool for curling, straightening and drying locks of wet hair using microwaves. The tool comprises a chamber in which is placed a magnetron and around which a lock of hair is wound. As a variant, the magnetron is placed outside the chamber and is connected thereto by a waveguide which extends into the chamber.

Patent DE 3148538 describes a cylindrical tool, protected with a wall, around which a lock of hair is wound. The lock is dried and set using microwaves diffused in the space between the cylinder and the wall.

Application FR 2 178 049 discloses devices for releasing electromagnetic energy in various materials.

Moreover, processes for heating and drying the hair using electromagnetic radiation are known from FR 2 114 540 and FR 2 118 945.

Application FR 2 959 917 describes a process for treating hair with microwaves. There is a need for novel processes and devices for permanently reshaping the hair. There is especially interest in providing processes for obtaining improved lasting shaping performance, while at the same time minimizing, or even eliminating, the use of chemical products.

The present invention is directed toward meeting this need.

According to a first aspect, the present invention relates to a cosmetic process for treating the hair, comprising at least the steps consisting in:

a) applying a mechanical stress to at least one lock of hair, via a mechanical-stress-application device, having a reception surface intended to receive the lock of hair, this surface being greater in width L in a direction perpendicular to said lock, b) exposing the hair thus placed under mechanical stress to microwaves by virtue of a microwave emission antenna placed inside the mechanical-stress-application device, this antenna extending axially over a distance D which is at least equal to L/2, the mechanical-stress-application device and at least one part of the lock to be treated being received in a microwave-proof chamber.

The present invention may allow a long-lasting hair shaping treatment that is less aggressive for the scalp and hair than some known treatments.

In particular, the application of a mechanical stress to the hair in the presence of microwaves makes it possible to obtain a long-lasting and improved shaping of the hair in the actual absence of alkali metal or alkaline-earth metal hydroxides.

The emitting of microwaves with a relatively long antenna facilitates the obtaining of more uniform distribution of the waves and of the corresponding heating. Preferably, the antenna extends axially over a distance D at least equal to 60%, better 70%, still better 80% of L. The axial extension of the antenna is preferably measured between a free end thereof, i.e. not connected to anything, and a connected end thereof opposite the free end, the connected end of the antenna being for example connected to a RF generator via a waveguide.

The expression "mechanical stress applied to the hair" should be understood as meaning a mechanical stress applied to at least a portion of the length of said hair. Irrespective of the embodiment under consideration, the hair treated in step a) may be subjected to one or more mechanical constraints. The mechanical constraint(s) may be chosen from bending, straightening, compression, torsion and/or traction constraints. The constraints applied may be intended to curl the hair or, on the contrary, to straighten it. The constraints applied may also be intended to curl the hair over one portion of its length and to straighten it over another portion of its length.

Microwaves

The term "microwaves" should be understood as meaning electromagnetic radiation with a frequency of between 500 MHz and 300 GHz.

The microwave frequency during step b) is preferentially between 1 GHz and 10 GHz, better still ranges from 2 to 3 GHz, particularly strictly greater than 2 GHz and less than 3 GHz, being for example about 2.45 GHz.

The power of the microwaves used during step b) may be less than or equal to 500 W, preferably between 30 and 300 W, better still from 100 to 250 W, even better still from 100 to 200 W or from 100 to 175 W. A power superior to 100 W has the advantage of treating the hair more efficiently, in a limited period.

The microwaves may be generated inside the mechanical-stress-application device or the microwave-proof chamber or outside by a microwave generator, for example a solid-state generator such as a magnetron. An external microwave generator can supply one or more devices according to the invention, in particular by means of flexible waveguides.

Preferably, the generator is outside the chamber.

In this case, the generator can be connected to a plurality of antennae, each linked to a mechanical-stress-application device.

Each antenna can be connected to a high-frequency stage corresponding to the generator.

In a variant, several antennae can be connected to one and the same high-frequency stage of the generator.

In another variant, the generator is located inside the chamber, in particular inside the mechanical-stress-application device.

According to one preferred embodiment of the invention, the microwave emission is carried out by a non-rectilinear, preferably helical, antenna.

The antenna may be formed from a sufficiently rigid wire, for example with a diameter between 1 and 3 mm, so as not to require any holding or rod for support of the loops. In one variant, the antenna comprises a flexible wire or conductive part placed on a support structure, which is in particular helical. This support structure may be made of any dielectric material, preferably made of PTFE or glass.

The antenna, when it is helical, preferably has a fixed helical pitch, for example between 4 and 5 mm. The radius of the helix is preferably constant, for example between 4 and 10 mm. The damage of the antenna is for example between 8 and 10 mm.

The axial extension of the antenna is for example between 50 mm and 80 mm, better still between 65 mm and 75 mm.

The antenna may be placed in a tube, which is in particular closed at one end. This tube may be made of PTFE or of another dielectric material.

The antenna may also be embedded in a dielectric material, which is preferably flexible, in particular silicone.

A helical antenna shape is particularly advantageous in that it is easy to produce, it allows the antenna to keep a relatively small diameter suitable for its insertion into the mechanical-stress-application device, and it makes it possible to obtain a relatively uniform microwave distribution.

During step a) above, the microwave radiation may or may not already exist. In other words, steps a) and b) may take place simultaneously or successively.

Mechanical-Stress-Application

The mechanical stress applied may be a bending, a tension, a twisting and/or a compression, between other mechanical actions.

Preferably, the mechanical-stress-application device is a curler. The term "curler" denotes a device for winding the hair around the longitudinal axis of the device according to a defined diameter, thus creating a mechanical stress, which depends on the diameter. When the mechanical-stress-application device is a curler, it is most particularly advantageous for the antenna to be helical.

The axial dimension of the antenna is at least 50%, and preferably at least 70%, of the length N of the mechanical-stress-application device, in particular when it is of the curler type.

The treatment device may be configured so as to make it possible to use several mechanical-stress-application devices. These application devices can exert different constraints, serving for example to curl the hair or, conversely, to straighten it. The mechanical-stress-application devices can be interchangeable by the user.

The mechanical-stress-application may be configured, as appropriate, so as to place the treated hair flat during the exposure to the microwaves.

The treatment device may be arranged to automatically recognize the constraint-application device used, where appropriate, for example by means of electrical contacts or one or more switches.

Where appropriate, the mechanical-stress-application device and the antenna form a unit assembly which is introduced into the chamber. It is possible to have an antenna specific to each mechanical-constraint-application device, in order in particular to arrange the antenna in the best way possible with respect to said device.

The mechanical-constraint-application device, when it is constituted of a curler, can comprise several flexible branches connecting two annular parts. The branches define the surface for receiving the hair. This surface can be radially delimited by teeth which are connected at their base to a corresponding annular part. Centering blocks can be produced on the annular parts. These blocks can also serve, as appropriate, to attach elastic bands for holding the hair.

The mechanical-constraint-application device can be made of PTFE or of other dielectric materials, in particular thermoplastics.

Solvent

Preferably, the exposure to microwaves in step b) is carried out in the presence of a solvent in contact with the hair.

The solvent is preferably in vapor form during the treatment.

The solvent can be a compound present, before emission of the microwaves, on contact with the treated hair.

Preferably, the treated hair is never totally dry throughout the entire action of the microwaves. In other words, the hair preferably always remains impregnated with the solvent during said exposure.

In order to facilitate the impregnation of the hair with the solvent, the latter can be sprayed onto the hair prior to the application of the mechanical stress.

Preferably, the treatment is carried out without there being complete drying of the hair throughout the exposure to the microwaves. The expression "without there being complete drying of the hair" signifies that, after step b), the hair feels wet. The hair may thus conserve at least 1%, especially at least 2% or even 5% of the weight of the liquid compounds present, before step b), on contact therewith, these liquid compounds adding to the natural humidity of the hair before treatment.

Microwave-Proof Chamber

The chamber, at least during step b), contains the hair to be treated and the device for applying a mechanical stress.

The term "contain the hair" should be understood as meaning contain the hair over all or part of its length and over a given width.

The chamber can cover the hair over a length for example of greater than or equal to 5 cm. Thus, a length of at least 5 cm of hair can be treated in the chamber.

The chamber may be immobile relative to the hair treated during the emission of the microwaves or mobile relative to the hair, making it possible to treat a greater length of hair. The chamber may be configured so as not to release into the external environment the abovementioned solvent in vapor form, or so as to release only a small amount thereof, for example by means of recycling of the solvent, the recycling taking place, for example, in vapor or liquid form, after condensation of the solvent.

The chamber may comprise a material configured to absorb the solvent in vapor form. The chamber may comprise a cold wall on which the solvent condenses and/or a loop for sucking up solvent in vapor form.

Thus, the process according to the invention may comprise, during and/or after step b), a step of re-collecting the solvent, for example in vapor and/or liquid form and/or absorbed on a material.

The chamber may comprise at least one seal of an electrically conductive material, which is, for example, elastically deformable, making it possible to block the microwaves used during step b) while allowing the hair to leave the chamber. The seal may comprise a foam filled with electrically conductive particles, a brush formed from electrically conductive bristles or a comb comprising metal teeth.

It is possible to coat the housing which receives the constraint-application device with a conductive foam which is placed so as to run over into the hair exit slit. This makes it possible to obtain a good seal of the closure, by virtue of the deformability of the foam at the slit.

When the chamber is in the form of a hood, the chamber may comprise electromagnetic shielding through which the treated hair may pass. Such shielding makes it possible to treat the user's hair while protecting the user's skull from the microwaves emitted.

The electromagnetic shielding is formed, for example, by a grate or a metallic grating.

Various Characteristics

The treatment device for performing the process may comprise an audible and/or luminous warning system, for example for warning the user of a microwave leak out of the chamber and/or of an excessive temperature inside the chamber.

The treatment device advantageously comprises a safety system for preventing the emission of microwaves while the chamber is not closed and/or in the event of abnormal operation, for example of a microwave leak, of excessive temperature and/or in the absence of solvent.

The treatment device may be configured to control the duration of emission of the microwaves, so as not to reach a duration of treatment that is liable to damage the hair.

The process according to the invention may comprise, before step b), a step of detecting the closure of the chamber. For example, a contactor is actuated when the chamber is closed.

The emission of the microwaves may be conditioned to the detection of closure of the chamber. After the microwaves have been sent, the continuation of the microwave emission can be conditioned in the absence of the detection of a microwave leak, in particular using a microwave-sensitive sensor placed outside the chamber.

The process according to the invention may also comprise a step of detecting the emplacement of the hair intended to be treated, before step b). This detection step may be performed, for example, by an optical sensor and/or a mechanical feeler. The detection may be carried out, as appropriate, indirectly, by detecting the emplacement of the mechanical-stress-application device.

The process according to the invention may comprise, for example during step b), a step of measuring the temperature to which the treated hair is subjected. This temperature measurement step may be performed by a thermometer without contact with the hair.

The treatment device may comprise, within the same hand-held piece, the microwave generator and the mechanical-stress-application device. The term "hand-held piece" denotes a piece manipulated by the user in one hand during the hair treatment.

As conveying means that may be used for conveying the microwaves from the generator to the chamber, mention may be made of waveguides, for example a flexible coaxial cable less than 10 m long, preferably less than 5 m long, less than 5 cm and preferably less than 2 cm in external diameter.

The solvent is for example a liquid with a boiling point below 200° C. Preferably, this solvent comprises water. Even more preferentially, this solvent is water.

The solvent, when it is in vapor form, may have, in the region of and/or in contact with the hair, during step b), a temperature of between 80 and 200° C. and preferably between 100 and 150° C., for example between 120 and 150° C.

The pressure to which the treated hair is subjected, during step b), may be between $10^5$ and $10^6$ Pa (1-10 bar), preferably between $10^5$ and $5\times10^5$ Pa (1-5 bar).

The treatment device may comprise a sensor that is sensitive to a characteristic of the hair, for example the color, the mechanical strength, the surface state or the humidity, and the treatment device may control at least one parameter of the treatment as a function of the characteristic thus detected, for example the microwave energy, the solvent temperature, the duration of the treatment and/or the mechanical constraint exerted.

Application of One or Hair Compositions

The process according to the invention may, in addition, comprise at least one step c) consisting in applying to the hair at least one hair treatment composition.

The expression "hair treatment composition" is intended to mean a composition capable of modifying the chemical properties of the hair or the shaping thereof.

The cosmetic properties in question are disentangling, softness and sheen.

The hair shaping can be long-lasting or temporary hair shaping.

The expression "temporary hair shaping composition" should be understood to be a composition which, once applied to the hair, allows shaping without opening of the disulfide bonds present within the keratin.

The temporary hair shaping is preferably then obtained through the use in the invention of a composition comprising one or more fixing polymers, the nature of which may be anionic, nonionic, cationic or amphoteric.

The expression "long-lasting hair shaping composition" should be understood to be a composition which, once applied to the hair, allows opening of the disulfide bonds present within the keratin.

The long-lasting hair shaping compositions of the invention comprise one or more agents for breaking the disulfide bonds, preferably chosen from reducing agents or hydroxide compounds.

The preferred reducing agents are thiols.

Preferably, the composition of step c) is a long-lasting hair shaping composition.

Step c) can take place before step a) and/or after step b).

Steps a) and b) can reinforce the action of the hair shaping composition, and make it possible, for example, to reduce the content of active agents or, at equal content, to increase its effectiveness or reduce the leave-on time of said composition.

The process according to the invention may, in addition, comprise at least one step d), after step c), consisting in applying to the hair at least one fixing composition.

The expression "fixing composition" should be understood to be a composition which, once applied to the hair, makes it possible to reconstitute disulfide bonds present within the keratin and thus contributes to maintaining the hairstyle in the desired shape. The fixing composition may also make it possible to improve the persistence of the shape obtained by the action of the hair shaping composition.

This step d) can take place before step a) and/or after step b) while at the same time remaining after step c).

The duration of step b) may vary according to the desired shaping performance qualities and the nature of the hair, for example.

Irrespective of the implementation examples considered, the duration of step b) may be between 1 s and 30 min, preferably between 1 s and 10 min.

Irrespective of the embodiments under consideration, step b) may be repeated, for example between 0 and 10 times and preferentially between 0 and 5 times.

The hair shaping or fixing compositions may be applied while the hair is present in the chamber, for example by virtue of a suitable application system. The application system comprises, for example, a pad, a comb, one or more dispensing orifices or a spray nozzle, arranged in the chamber or outside it, for example on the path of the hair leaving or entering the chamber.

The hair shaping composition and/or the fixing composition may be subjected, as appropriate, to microwave radiation.

Long-Lasting Hair Shaping Composition

Reducing Composition

Reducing Agents

The hair shaping composition may be a reducing composition comprising one or more reducing agents.

The reducing agent can for example be chosen from:

thioglycolic acid of formula (1):

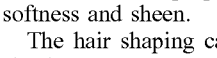

$$HS—CH_2—COOH \quad (1),$$

thiolactic acid of formula (2):

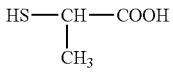

3-mercaptopropionic acid of formula (3):

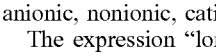

$$HS—CH_2—CH_2—COOH \quad (3),$$

cysteamine of formula (4):

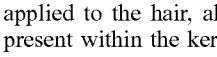

$$HS—CH_2—CH_2—NH_2 \quad (4),$$

cysteine of formula (5):

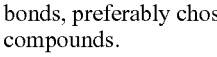

$$HS—CH_2—CH(NH_2)—CO_2H$$

and also the salts thereof and the esters thereof, phosphines, sulfites, borohydrides.

Among the cosmetically acceptable salts of the products (1) to (4) above, mention may for example be made of the ammonium salts, the primary, secondary or tertiary amine salts, and the alkaline-earth metal salts. As primary, secondary or tertiary amine salts, mention may be made of, respectively, monoethanolamine, diisopropanolamine and triethanolamine.

Among the esters of the compounds (1) to (4) above, mention may be made of glyceryl monothioglycolate, ethylene glycol monothioglycolate, the azeotropic mixture of 2-hydroxypropyl thioglycolate and of hydroxy-2-methyl-1-ethyl thioglycolate described in patent application FR-A-2 679 448, glyceryl monothiolactate, ethylene glycol monothiolactate, glyceryl 3-mercaptopropionate and ethylene glycol 3-mercaptopropionate.

The chemical reducing agent(s) may be present in a content for example between 0.01% and 20%, preferably between 0.1% and 10%, better still 0.3% and 3% by weight, relative to the total weight of the reducing composition.

Additives Present in the Reducing Composition

The reducing composition may also comprise one or more additives.

The additives may be used, in the reducing composition, alone or as mixtures.

The reducing composition may comprise at least one surfactant, for example a nonionic, anionic, cationic or amphoteric surfactant, and, among these, mention may be made of alkyl sulfates, alkylbenzene sulfates, alkyl ether sulfates, alkylsulfonates, quaternary ammonium salts, alkylbetaines, oxyethylenated alkylphenols, fatty acid alkanolamides, oxyethylenated fatty acid esters, and also other nonionic surfactants of the hydroxypropyl ether and alkyl polyglycoside type.

The surfactant(s) may for example be present in a content of less than 30% by weight, and preferably of between 0.5% and 10% by weight, relative to the total weight of the producing composition.

With the objective of improving the cosmetic properties of the hair or else of reducing and/or preventing degradation thereof, the reducing composition may also comprise at least one treating agent of cationic, anionic, nonionic or amphoteric nature.

Among the treating agents that are particularly preferred, mention may in particular be made of those described in French patent applications FR 2 598 613 and FR 2 470 596.

Use may also be made, as treating agents, of volatile or nonvolatile, linear or cyclic silicones and mixtures thereof, polydimethylsiloxanes, quaternized polyorganosiloxanes, such as those described in French patent application FR 2 535 730, polyorganosiloxanes comprising amino alkyl groups modified with alkoxycarbonyalkyl groups, such as those described in application U.S. Pat. No. 4,749,732, polyorganosiloxanes, such as the polydimethylsiloxane-polyoxyalkyl copolymer of the Dimethicone Copolyol type, a polydimethylsiloxane comprising stearoxy-end groups (stearoxydimethicone), a polydimethylsiloxane-dialkylammonium acetate copolymer or a polydimethylsiloxane-polyalkylbetaïne copolymer, described in British patent application GB 2 197 352, polysiloxanes organo-modified by mercapto or mercaptoalkyl groups, such as those described in French patent FR 1 530 369 and in European patent application EP 295 780, and also silanes, such as stearoxytrimethylsilane.

The reducing composition may also comprise other treating agents, for example cationic polymers such as those used in the compositions of French patents FR 2 472 382 and FR 2 495 931, or else cationic polymers of the ionene type, such as those used in the compositions of Luxembourg patent No. 83703. It may also comprise basic amino acids, for example lysine or arginine, or acidic amino acids, for example glutamic acid or aspartic acid, peptides and derivatives thereof, protein hydrolysates, waxes, swelling and penetrating agents, or agents which make it possible to reinforce the efficiency of the reducing agent, such as the $SiO_2$/PDMS (polydimethylsiloxane) mixture, dimethylisosorbitol, urea and derivatives thereof, pyrrolidone, N-alkylpyrrolidones, solvents, for instance alkylene glycol alkyl ethers or dialkylene glycol alkyl ethers, such as for example propylene glycol monomethyl ether, dipropylene glycol monomethyl ether, ethylene glycol monoethyl ether and diethylene glycol monoethyl ether, $C_3$-$C_6$ alkanediols, such as for example 1,2-propanediol and 1,2-butanediol, 2-imidazolidinone, and also other compounds, such as fatty alcohols, lanolin derivatives, active ingredients such as pantothenic acid, agents for reducing hair loss, antidandruff agents, thickeners, suspending agents, sequestrants, opacifiers, dyes, sunscreens and also fragrances and preserving agents. The pH of the reducing compositions is preferably between 6 and 11, better still between 7 and 10.

The reducing composition may comprise, for adjusting the pH, at least one basifying agent.

The basifying agent, preferably, used in the compositions according to the invention is an agent which can make it possible to increase the pH of the composition(s) in which it is present.

The basifying agent may be a Bronsted, Lowry or Lewis base.

The basifying agent may be mineral or organic.

The basifying agent can for example be chosen from:

a) aqueous ammonia, b) alkanolamines such as monoethanolamines, diethanolamines and triethanolamines, and also derivatives thereof, c) oxyethylenated and/or oxypropylenated ethylenediamines, d) alkali metal silicates such as sodium metasilicates, e) amino acids, preferably basic amino acids such as arginine, lysine, ornithine, citrulline and histidine, f) (bi)carbonates particularly of a primary, secondary or tertiary amine (ammonium) or of an alkali metal or alkaline-earth metal, and g) the compounds of formula (II) below:

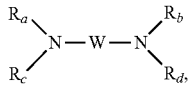

(II)

in which W is a propylene residue optionally substituted with a hydroxyl group or a $C_1$-$C_4$ alkyl radical. The $R_a$, $R_b$, $R_c$ and Rd groups are identical or different and it can be a hydrogen atom or a $C_1$-$C_4$ alkyl or $C_1$-$C_4$ hydroxyalkyl radical.

Preferred basifying agents may be aqueous ammonia and monoethanolamine.

The basifying agent(s), for example as defined above, may be present in a content of preferably between 0.001% and 10%, for example between 0.005% and 8%, by weight relative to the weight of the reducing composition. This concentration can in particular depend on the desired pH of the reducing composition.

Conditions for Applying the Reducing Composition

In one preferred implementation example, when it is applied before step a) and/or after step b), the reducing composition may be left to act for example for a period of between 1 and 50 minutes, preferably between 1 and 30 minutes.

In the case of the application before step a), the temperature will rise during the application of the microwaves. In addition, the reducing composition is preferably applied to hair fibers that are wet and clean.

Composition Comprising a Hydroxide Compound.

The long-lasting hair shaping composition may comprise one or more hydroxide compounds.

Hydroxide Compound

The term "hydroxide compound" should be understood to be a compound capable of releasing hydroxide ions. All the hydroxide compounds normally used in lanthonization processes can be used in the hair shaping composition used in the context of the invention.

The at least one hydroxide compound can preferably be chosen from alkali metal hydroxides, alkaline-earth metal hydroxides, transition metal hydroxides, lanthanide metal hydroxides, actinide metal hydroxides, Group III metal hydroxides, Group IV metal hydroxides, Group V metal hydroxides, Group VI metal hydroxides, organic hydroxides, and compounds comprising at least one partially hydrolyzable hydroxide constituent.

As hydroxide compound that can be used in the context of the present invention, mention may be made for example of sodium hydroxide, guanidinium hydroxide, lithium hydroxide, calcium hydroxide, barium hydroxide, magnesium hydroxide, aluminum hydroxide, copper hydroxide, strontium hydroxide, molybdenum hydroxide, manganese hydroxide, zinc hydroxide and cobalt hydroxide.

The preferred hydroxide compounds are sodium hydroxide and guanidinium hydroxide. Preferably, their concentration is such that the pH of the composition is between 12 and 14.

The hydroxide compound(s) may be present in the hair shaping composition in a concentration of between 0.2 and 1 M, preferably between 0.4 and 0.6 M.

Emulsifiers

The hair shaping composition comprising a hydroxide compound may be at least partially in the form of an emulsion, preferably an oil-in-water or water-in-oil emulsion.

In the latter case, it may comprise at least one nonionic, anionic, cationic amphoteric emulsifying agent.

The emulsifiers are surfactants and are chosen according to the emulsion to be obtained, for example water-in-oil (W/O) or oil-in-water (O/W) emulsion.

When it is sought to obtain a hair shaping composition comprising an emulsion for example as described above, use may be made of:

- amphoteric emulsifiers, for example N-acylamino acids, such as N-alkylamino acetates and disodium cocoamphodiacetate, and amine oxides such as stearamine oxide,
- anionic emulsifiers, for example acyl glutamates such as "disodium hydrogenated tallow glutamate" (Amisoft HS-21® sold by the company AJINOMOTO); carboxylic acids and salts thereof such as sodium stearate; phosphoric esters and salts thereof such as "DEA oleth-10 phosphate"; sulfosuccinates such as "Disodium PEG-5 citrate lauryl sulfosuccinate" and "Disodium ricinoleamido MEA sulfosuccinate",
- cationic emulsifiers, for example alkyl imidazolidiniums such as isostearyl ethylimidonium ethosulfate; ammonium salts such as N,N,N-trimethyl-1-docosanaminium chloride (behentrimonium chloride), and
- nonionic emulsifiers, for example, saccharide esters and ethers such as sucrose stearate, sucrose cocoate, and the mixture of sorbitan stearate and sucrose cocoate sold by the company ICI under the name Arlatone 2121®; polyol esters, for example glycerol or sorbitol esters, such as glyceryl stearate, polyglyceryl-2 stearate, sorbitan stearate; glycerol ethers; oxyethylenated and/or oxypropylenated ethers, such as the oxyethylenated, oxypropylenated ether of lauryl alcohol containing 25 oxyethylenated groups and 25 oxypropylenated groups (CTFA name "PPG-25 laureth-25") and the oxyethylenated ether of the mixture of $C_{12}$-$C_{15}$ fatty alcohols comprising 7 oxyethylenated groups (CTFA name "$C_{12}$-$C_{15}$ Pareth-7"), polymers of ethylene glycol, such as PEG-100 and mixtures thereof.

One of these emulsifiers may be used.

For the water-in-oil (W/O) emulsions, mention may be made, as example of emulsifiers, of polyol fatty esters, in particular glycerol or sorbitol fatty esters, and in particular polyol isostearic, oleic and ricinoleic esters, such as the mixture of petrolatum, polyglyceryl-3 oleate, glyceryl isostearate, hydrogenated castor oil and ozokerite sold under the name Protegin W® by the company Goldschmidt, sorbitan isostearate, polyglyceryl diisostearate, polyglyceryl-2 sesquiisostearate; polysaccharide esters and ethers, such as "Methyl glucose dioleate"; fatty esters, such as magnesium lanolate; dimethicone copolyols and alkyl dimethicone copolyols, such as the lauryl methicone copolyol sold under the name Dow Corning 5200 Formulation Aid by the company Dow Corning, the cetyl dimethicone copolyol sold under the name Abil EM 90® by the company Goldschmidt, and dimethicone copolyol; and mixtures thereof.

The oils of the emulsions may be plant oils, mineral oils, silicone oils, liquid esters, or linear or branched $C_7$-$C_{16}$ hydrocarbons.

Conditions for Applying the Composition Comprising a Hydroxide Compound

In one preferred implementation example, when it is applied before step a) and/or after step b), the composition comprising a hydroxide compound is left to act for example for a period of between 5 and 60 minutes, preferably between 10 and 20 minutes.

After the step of applying the composition comprising a hydroxide compound, and after and optional leave-on time, the hair may be rinsed, preferably with running water and with osmotically treated water, or even with an acid composition in order to remove the alkalinity residues.

Acid Composition

The term "acid composition" should be understood to be a composition comprising one or more acids, for example chosen from acids comprising one or more carboxylic, sulfonic, phosphoric or phosphoric acid functions.

The acids may comprise other chemical functions, in particular hydroxyl or amino functions.

The acids may be saturated or unsaturated.

As acid that can be used, mention may for example be made of acetic acid, propanoic acid, butanoic acid, lactic acid, glycolic acid, ascorbic acid, maleic acid, phthalic acid, succinic acid, taurine and citric acid.

One preferred acid is citric acid.

The mineral acid(s) present in the composition may be chosen from acids that are monoacids or polyacids.

Mention may for example be made of hydrochloric acid, orthophosphoric acid, sulfuric acid and boric acid.

The acid composition may for example have a pH of between 2 and 7, preferably between 3 and 4.

Oxidizing Composition

The fixing composition is an oxidizing composition.

The expression "oxidizing composition" should be understood to mean compositions comprising for example one or more oxidizing agents for example chosen from hydrogen peroxide, urea peroxide, alkali metal bromates, polythionates, and persalts such as perborates, percarbonates and persulfates.

The oxidizing agent is preferably hydrogen peroxide.

The oxidizing agent(s) may be present in a content of between between 0.1% and 10%, preferably between 0.5% and 5%, by weight, relative to the total weight of the oxidizing composition.

Preferably, when the oxidizing agent is hydrogen peroxide in aqueous solution, the oxidizing composition used in the process according to the invention contains at least one stabilizer of aqueous hydrogen peroxide solution.

Mention may for example be made of alkali metal or alkaline-earth metal pyrophosphates, such as tetrasodium pyrophosphate, alkali metal or alkaline-earth metal stannates, phenacetin or oxyquinoline acid salts, for instance oxyquinoline sulfate. Even more advantageously, use is made of at least one stannate optionally in combination with at least one pyrophosphate.

The stabilising agent(s) of the aqueous hydrogen peroxide may be present in a content of between between 0.0001% and 5%, preferably between 0.01% and 2%, by weight, relative to the total weight of the oxidizing composition.

The oxidizing composition may for example have a pH of between 1.5 and 4.5, preferably between 2 and 3.5, in particular when the oxidizing agent is hydrogen peroxide.

In one preferred implementation example, when it is applied before step a) and/or after step b), the oxidizing composition as defined above is left to act for about 2 to 30 minutes, preferably for 2 to 15 minutes, more particularly between 2 and 7 minutes. The oxidizing composition is preferably applied to clean wet hair.

The carrier of the reducing and oxidizing compositions is preferably an aqueous medium made up of water and can advantageously contain cosmetically acceptable organic solvents, more particularly including alcohols such as ethyl alcohol, isopropyl alcohol, benzyl alcohol and phenylethyl alcohol, or polyols or polyol ethers, for instance ethylene glycol monomethyl, monoethyl or monobutyl ether, propylene glycol or ethers thereof, for instance propylene glycol monomethyl ether, butylene glycol, dipropylene glycol, and also diethylene glycol alkyl ethers, for instance diethylene glycol monoethyl ether or monobutyl ether. The organic solvents may then be present in concentrations of between about 0.1% and 20% and preferably between about 1% and 10% by weight relative to the total weight of the composition.

The pHs of the oxidizing composition in the process according to the invention can be obtained and/or adjusted conventionally by adding either one or more basifying agents, such as those already mentioned in the reducing composition, or acidifying agents such as, for example, hydrochloric acid, acetic acid, lactic acid, boric acid, citric acid and phosphoric acid.

All the compositions used in the process according to the invention may be, independently of each other, in the form of a thickened or unthickened lotion, a cream, a gel or a mousse.

Treatment Devices

According to another of its aspects, the present invention relates to a hair treatment device, in particular for performing the process as defined above, comprising:

- at least one device for applying mechanical stress to at least one lock of hair, in particular configured so as to exert at least one twisting, tensile or compressive constraint on hair to be treated,
- a microwave-proof chamber which is configured so as to receive the mechanical-stress-application device and at least one part of the hair to be treated,
- a microwave emission antenna placed inside the chamber, preferably inside the mechanical-stress-application device.

All the characteristics stated with regard to the above process apply to this treatment device.

Thus, the antenna is preferably helical.

The mechanical-constraint-application device has a surface for receiving the hair, which extends over a width L, and the antenna extends axially, preferably over a distance greater than or equal to L/2.

A subject of the invention is also, independently or in combination with the aforementioned, a hair treatment device, in particular for performing the process as defined above, comprising:

- a device for applying mechanical stress to at least one lock of hair, preferably a curler,
- a microwave-proof chamber which has a housing configured so as to receive the mechanical-stress-application device and at least one part of the hair to be treated, a microwave emission antenna, place inside the chamber, the housing for receiving the mechanical-constraint-application device being defined at least partially by a drawer that is mobile relative to the antenna between an open position enabling the emplacement and the removal of the mechanical-constraint-application device, and a closed position in which the chamber is microwave-proof and the antenna approaches the mechanical-constraint-application device.

Preferably, the antenna and the mechanical-constraint-application device are arranged in such a way that, in the closed position of the drawer, the antenna is engaged inside the mechanical-constraint-application device.

According to this aspect of the invention, the microwave emission antenna may be any microwave emission antenna, but it preferably has the abovementioned length and shape characteristics.

According to this aspect, the invention has the advantage of allowing easy emplacement and removal of the mechanical-constraint-application device, in particular with a lock of hair wound on it.

Furthermore, the detection of the position of the drawer provides a simple means for verifying the correct closure of the chamber before the triggering of the microwave emission.

The drawer can be produced with an end wall on the side opposite the antenna, which closes the chamber when the drawer is in the closed position.

Preferably, the drawer slides relative to a casing, which houses the antenna, particularly along an axis of sliding parallel to a longitudinal direction of the casing. Preferably, the drawer slides relative to the casing without rotational movement around the axis of sliding.

A slit, preferably extending along a direction that is parallel to the axis of sliding, is made between the drawer and this casing, in the closed position, so as to allow the hair to exit.

This slit is advantageously edged with an electrically conductive coating, preferably a flexible foam, which fits over the hair in order to produce the microwave-proofness when the chamber is closed.

According to another of its aspects, a subject of the invention is also, independently or in combination with what has been disclosed regarding the process according to the invention, a hair treatment device, in particular for performing the process as defined above, comprising:

- a device for applying mechanical stress to at least one lock of hair, preferably a curler,
- a chamber defined at least partially by a casing which has a housing configured so as to receive the mechanical-stress-application device and at least one part of the hair to be treated, and by a cover that pivots relative to the casing between an open position giving access to the housing and a closed position, the microwave emission antenna being placed inside the housing, the housing being open at one end so as to allow, when the cover is open, the emplacement and removal of the mechanical-constraint-application device by an axial movement relative to the casing, the mechanical-constraint-application device and the antenna being arranged in such a way that the antenna inserts into the mechanical-constraint-application device when the latter is put in place in the housing.

According to this aspect of the invention, the microwave emission antenna may be any microwave emission antenna, but it preferably has the abovementioned length and shape characteristics.

According to this aspect, the invention has the advantage of allowing easy emplacement and removal of the mechanical-constraint-application device, in particular with a lock of hair wound on it.

Furthermore, the detection of the position of the cover provides a simple means for verifying the correct closure of the chamber before the triggering of the microwave emission.

The cover can be made with an end wall that extends transversally to the axis of rotation of the cover so as to form the opening of the housing via which the mechanical-constraint-application device is introduced or extracted.

The at least one cover and the housing can be equipped with an electrically conductive coating which fits over the hair when the cover is closed, in order to ensure the microwave-proofness of the chamber.

Preferably, a hair exit slit is made on the side opposite to the hinge via which the cover is articulated on the casing. The pivoting of the cover provides an additional tightening effect for pressing the electrically conductive coating on the hair.

The casing and the cover can be made with a reinforcement bordering this exit slit, so as to facilitate the raising of the cover.

DESCRIPTION OF THE FIGURES

The invention may be better understood from reading the following detailed description of non-limiting implementation examples thereof, and with reference to the appended drawing, in which:

FIG. 1 shows a treatment device 100 according to the invention, comprising a hand-held piece 3 connected via a flexible waveguide 2 to a base station 1 comprising a microwave generator.

Figure 1:
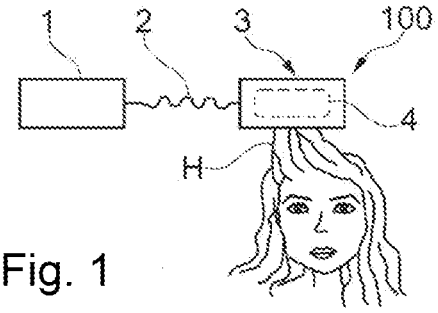
FIG. 1 is a partial schematic representation of an example of a treatment device according to the invention.
Figure 2:
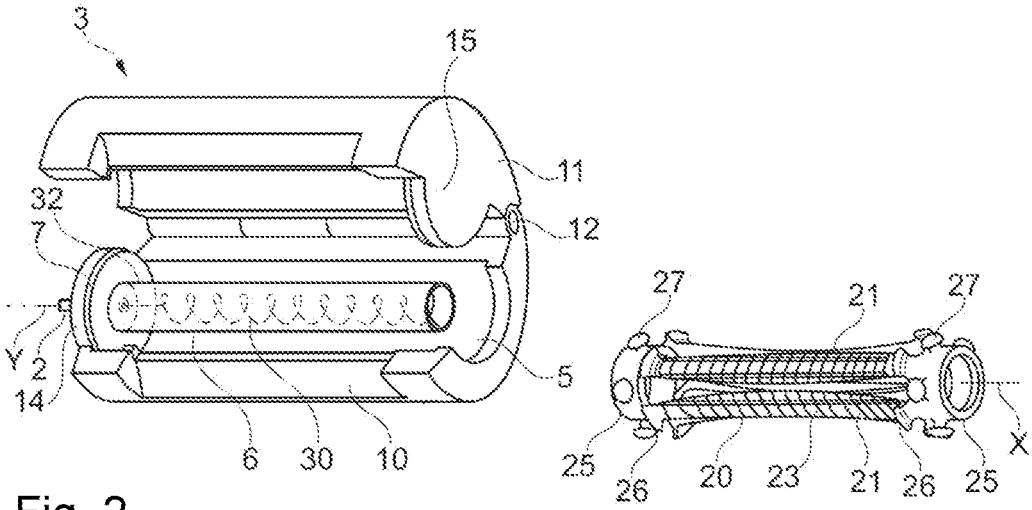
FIG. 2 is the open hand-held piece and the mechanical-stress-application device once extracted.
Figure 3:
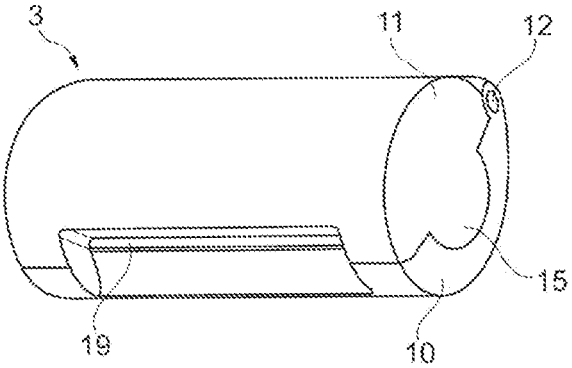
FIG. 3 is the closed hand-held piece.
Figure 4:
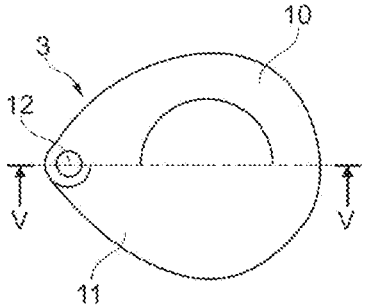
FIG. 4 is a side view of the hand-held piece from FIG. 3.
Figure 5:
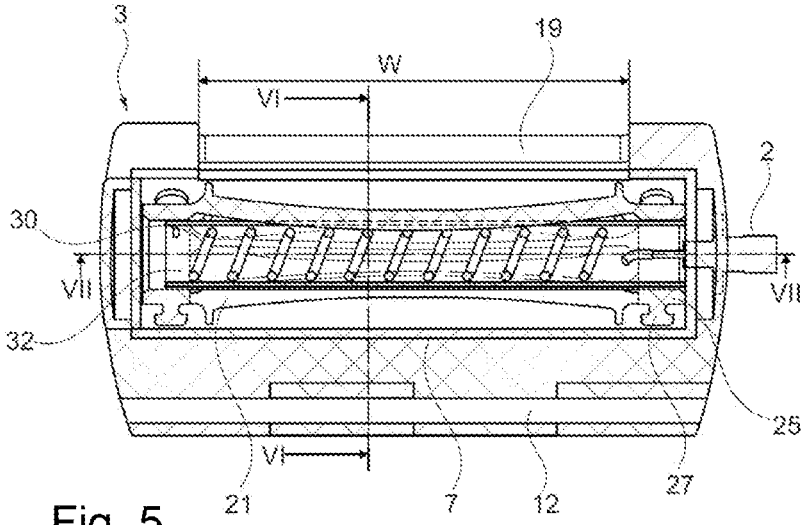
FIG. 5 is a longitudinal section along V-V of FIG. 4.

The flexible waveguide 2 is constituted by a shielded cable.

The hand-held piece 3 is anticipated to be manipulated by the user in order to be placed in proximity to the person's head for treating at least one lock of hair H, as illustrated.

The hand-held piece 3 can be produced in various ways and defines a microwave-proof treatment chamber 4.

FIGS. 2 to 8 show a first embodiment example of the hand-held piece 3.

The flexible waveguide 2 has been represented only very partially on these figures.

The hand-held piece 3 comprises a casing 10 on which a cover 11 is articulated by means of an axis 12.

The casing 10 defines a housing for receiving a mechanical-constraint-application device, constituted, in the example in question, by a curler 20.

Said curler comprises several branches 21 which define a surface for receiving the hair H, of width L, measured along the longitudinal axis X of the curler 20.

The axis X is, in this example, parallel to the axis of rotation of the cover 11.

In the example in question, the curler 20 comprises four branches 21, which are slightly curved toward the axis X and pass by a minimum distance to the axis X at about mid-length.

The branches 21 can have ribs 23 oriented perpendicular to the axis X for assisting in holding the lock spread out on the branches 21, while preferably occupying the entire width L as uniformly as possible.

The branches 21 connect at their ends to annular parts 25.

The curler 20 has teeth 26 at the ends of the branches 21, which laterally delimit the surface for receiving the hair.

The curler 20 can be made of any dielectric material, preferably of PTFE.

The curler 20 preferably has a symmetrical form of revolution relative to a median plane of symmetry perpendicular to the axis X.

The casing 10 carries an antenna 30 which is, in the example shown, helical in shape, with a longitudinal axis 7 which merges with the axis X when the curler 20 is in place.

The antenna 30 is, in the example in question, made up of a helical metal wire, place in a tube 32 of a dielectric material, for example silicone or PTFE.

The presence of this tube 32 facilitates the insertion of the antenna into the curler 20.

The casing 10 defines a housing 6 in which the curler 20 is placed.

The antenna 30 is supported at an axial end of the casing 10 by a plate 14 of the casing 10, which has a semicircular outline.

The cover 11 has a similar plate 15 on the opposite side, closing the opening 5 of the housing 6, by which the curler 20 is introduced into the hand-held piece 3.

The interior surface of the housing 6 is defined by an electrically conductive coating 7 which makes it possible to reflect the microwaves and makes the chamber 4 microwave-proof.

Figure 8:
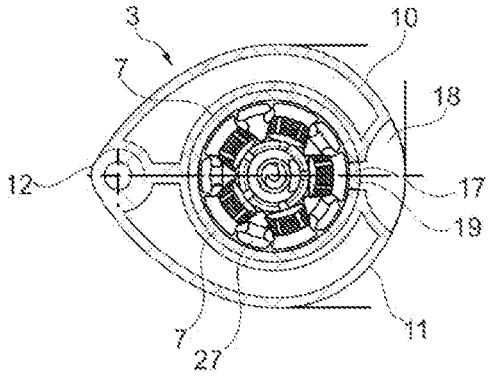
FIG. 8 is a view, similar to FIG. 6, when the chamber is closed.

The curler 20 comprises blocks 27 with a widened head, which connect at their base to the corresponding annular parts 25, which press against the coating 7, as shown in FIG. 8, so as to maintain the curler centered in the housing 6.

The blocks 27 are for example located between the teeth 26, as shown.

The coating 7 can be formed from a conductive foam which is for example semi-cylindrical in shape along the curler on the cover and the casing, in the form of a disk for the plate 15 and of a ring for the plate 14.

The casing 10 and the cover 11 define an exit slit 19 for the hair, located at the bottom of a reinforcement 18, on the side opposite the axis 12 of the hinge.

The coating 7 preferably protrudes into the slit 19 for the hair, as can be seen in FIG. 8, so as to produce a good closure seal despite the hair passing through.

Figure 6:
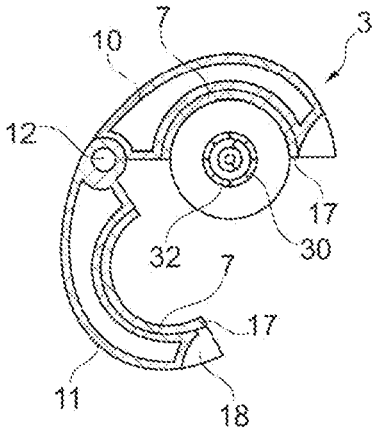
FIG. 6 is a cross section along VI-VI of FIG. 5.
Figure 7:
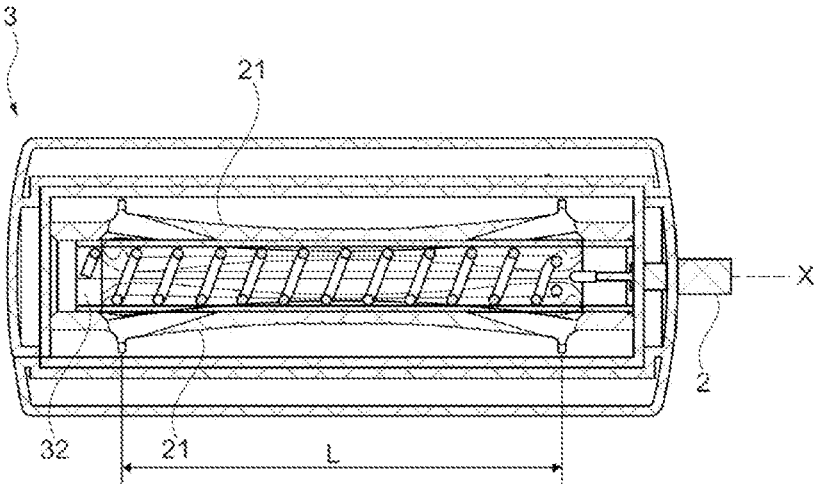
FIG. 7 is a longitudinal cross section along VII-VII of FIG. 5.

The edge of the coating can thus go slightly beyond, at 17, the edge of the body of the cover and that of the casing, as shown in FIG. 6, for closing the slit 19.

The hand-held piece 3 comprises a member for locking the cover in the closed position, not represented, and also an opening detector.

The width W of the slit 19 can be slightly greater than L, the length of the housing 6 being substantially equal to the length of the curler 20, such that the latter is immobilized both axially and radially in the housing 6, to within a slight amount of play.

In order to use the hand-held piece 3, a lock of wet hair is wound on the curler 20, then the latter is placed inside the casing 10 by moving it laterally relative to said casing, while introducing it by the opening 5. The cover 11 is then closed again, and the hair exits via the slit 19. Once the microwave exposure has been performed, the lock of hair is extracted by performing the operations in the reverse order.

Figure 14:
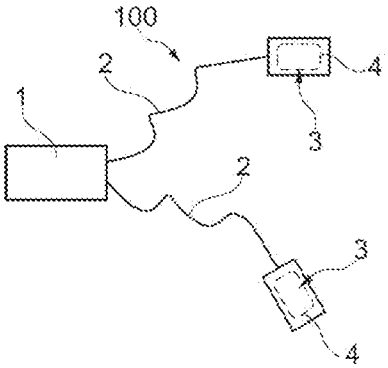
FIG. 14 is a view, similar to FIG. 1, of a variant of the treatment device according to the invention.

Several hand-held pieces 3 may be connected to one and the same generator 1, as shown in FIG. 14.

Comparative Tests: Curler with Rectilinear Antenna and Curler with Helical Antenna A curler with a straight antenna which comprises a central straight part formed from a hollow dielectric tube, made of glass, with two ends formed by PTFE disks, located on either side of the central part, is used.

The curler with a helical antenna comprises a metal antenna in the shape of the helix wound on a cylindrical PTFE bar, protected by a thin PTFE glove finger in order to facilitate the handling thereof and the introduction thereof into the curler.

| Curler/antenna | Number of tests | Average time up to 10° C. | Temperature homogeneity | Average percentage of reflected power |
|---|---|---|---|---|
| Straight antenna | 3 | 5 minutes +/− 2 | | 50% +/− 1.2 |
| Helical antenna | 4 | 40 s at 100 W<br>2.5 min at 50 W | Homogeneous improved (standard error less than 20) | 32% +/− 0.5 |

A variant of the hand-held piece 3 will now be described with reference to FIGS. 9 to 13.

Said hand-held piece comprises a casing 40 and a drawer 50 that can slide along the longitudinal axis of the casing.

Figure 12:
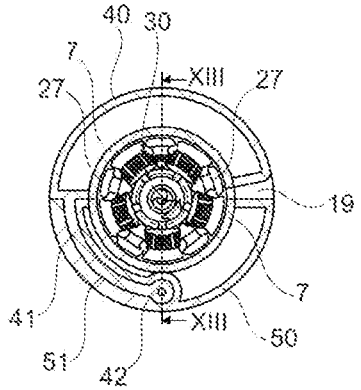
FIG. 12 is a cross section of the hand-held piece.
Figure 13:
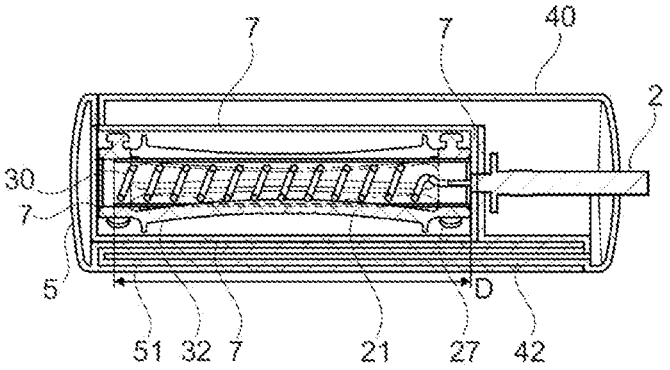
FIG. 13 is a longitudinal section along XIII-XIII of FIG. 12.

The casing 14 can in particular comprise an arc-shaped lug 41, engaged in a corresponding slide 51 of the drawer 50, as shown in FIG. 12. The lug 41 can be provided with a thickening 42 at the end, retained in a corresponding well, so as to hold the lug 41 in the slide 51.

The casing 40 carries the antenna 30.

The axis of the antenna 30 is parallel to the axis of sliding of the drawer 50.

The internal surface of the housing 6 for receiving the curler is covered with a conductive coating 7 as in the example described above.

An exit slit 19 for the hair is formed between the casing 40 and the drawer 50, the coating coming at rest, in the absence of hair, to block this slit as illustrated in FIG. 12.

An end plate 54 closes the housing 6 at its end opposite the casing 40.

Figure 9:
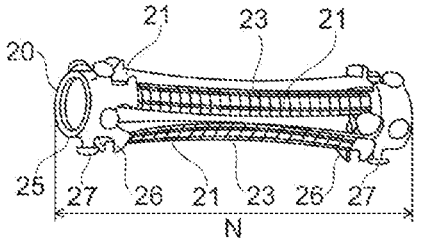
FIG. 9 is a view, similar to FIG. 2, of an embodiment variant of the hand-held piece.
Figure 9:
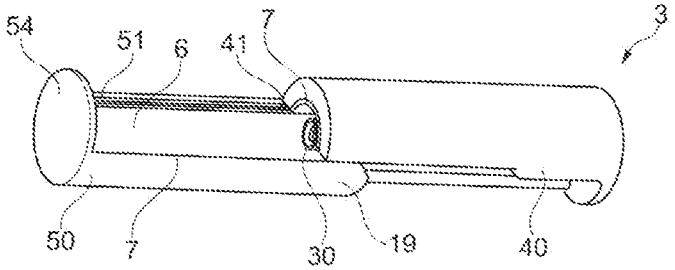
Figure 10:
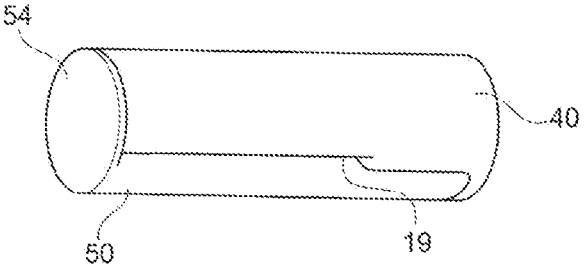
FIG. 10 is the hand-held piece of FIG. 9, in the closed position.
Figure 11:
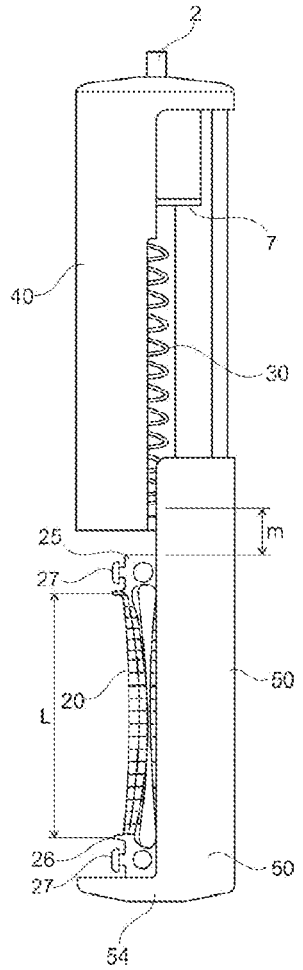
FIG. 11 is a side view of the hand-held piece in the open position with the constraint application device in place in the corresponding housing of the hand-held piece.

In order to use the hand-held piece 3, the curler with the lock wound on it is introduced into the housing 6, while the drawer is in the open position, as shown in FIG. 9. In this position, the drawer is sufficiently advanced for the antenna not to impair the emplacement of the curler.

The free end of the antenna 30 is at a distance m from the curler 20 in place in the housing 6, for example between 2 and 10 mm.

The casing 40 is then slid along so as to close the housing 6. At this time, the hair exits via the slit 19.

To extract the treated hair, the operations are performed in reverse order.

The external diameter of the antenna 30 is for example 9.2 mm for an internal diameter of the body of the curler of 22 mm.

A temperature detector may be present in the chamber 4, for example on an internal surface thereof, in order to measure the temperature of the treated lock of hair, and a control system, for example a microprocessor system, may make it possible to interrupt or modify the microwave emission in the event of a detected temperature above a predefined threshold.

Figure 15:
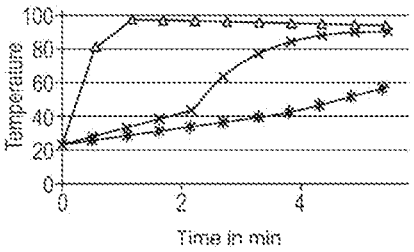
FIGS. 15 and 16 represent our results of comparative tests.
Figure 16:
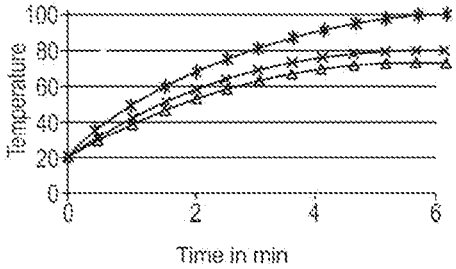

The increase in temperature over time for hair wound on curlers with a straight antenna and on those with a helical antenna is shown in FIGS. 15 and 16 respectively.

In the case of the straight antenna, the equivalent electric circuit has capacities C between the core and the walls and there is capacitive coupling.

The incident field is perpendicular to the surface of the core at any point and is therefore also perpendicular to the walls of the curler.

In the case of the helical antenna, there is a coupling which adds to that between the core and the walls, namely a coupling between the loops of the antenna. This induces capacitive and inductive couplings.

The field E is perpendicular to the surface of the antenna at any point and is not therefore perpendicular at all points to the walls of the curler. There is therefore a coming together of the field maxima and of the heat sources which are distributed better throughout the entire volume of the lock, which contributes to making the temperature uniform.

Increasing the length of the antenna increases the number of maxima and minima of the electric field around the antenna and, consequently, increases the number of heat sources in the lock of hair.

Furthermore, in the case of the helical antenna, the following are observed:

a decrease in the reflected power (Pr), an improvement in the homogeneity of the temperature along the curler between the straight antenna and the helical antenna for one and the same curler.

The advantage of an antenna having a relatively long length, which is in particular helical, which makes it possible to generate multiple heat sources along the lock, can thus be seen from these tests. These sources are quite close so as to contribute to making the desired heating uniform. The method of propagation of the microwaves in the lock is not affected by the change in the dielectric characteristics.

The invention claimed is:

1. A device for treating at least one lock of hair, comprising:

at least one device for applying mechanical stress to the hair, a microwave-proof chamber which is configured so as to receive the mechanical-stress-application device and at least one part of the hair to be treated, a microwave emission antenna placed inside the mechanical-stress-application device, wherein the chamber has a housing configured so as to receive the mechanical-stress-application device and at least one part of the hair to be treated, the microwave emission antenna being placed inside the chamber, the housing for receiving the mechanical-stress-application device being defined at least partially by a drawer that is mobile relative to the antenna between an open position allowing the emplacement and removal of the mechanical-stress-application device, and a closed position in which the chamber is microwave-proof and the antenna approaches the mechanical-stress-application device the mechanical-stress-application device being a curler, the device comprising a casing carrying the antenna, the drawer sliding along the longitudinal axis of the casing, the axis of the antenna being parallel to an axis of sliding of the drawer, the casing comprising an arc-shaped lug, engaged in a corresponding slide of the drawer, the internal surface of the housing being covered with a conductive coating, an exit slit for the hair being formed between the casing and the drawer, the coating being configured to come at rest, in the absence of hair, to block the slit, the device comprising an end plate closing the housing at its end opposite the casing.

2. The device as claimed in claim 1, the antenna extending axially over a distance D at least equal to 50% of a width L of the reception surface intended to receive the lock of hair, in a direction perpendicular to said lock.

3. The device as claimed in claim 1, the frequency of the microwave used is strictly greater than 2 GHz and less than 3 GHz.

4. The device as claimed in claim 1, wherein the antenna and the mechanical-stress-application device are arranged in such a way that, in the closed position of the drawer, the antenna is engaged inside the mechanical-stress-application device.

5. The device as claimed in claim 1, comprising a slit for the hair to exit the chamber, this slit being edged by an electrically conductive coating, which fits over the hair in order to produce the microwave-proofness when the chamber is closed.

6. The device as claimed in claim 1, wherein the length of the antenna represents at least 70% of the length of the mechanical-stress-application device.

7. A cosmetic process for treating the hair, using the device of claim 1, comprising the steps consisting of:

a) applying a mechanical stress to at least one lock of hair, via the mechanical-stress-application device, having a reception surface intended to receive the lock of hair, this surface being greater in width L in a direction perpendicular to said lock, b) exposing the hair thus placed under mechanical stress to microwaves by virtue of a microwave emission antenna placed inside the mechanical-stress-application device, this antenna extending axially over a distance D which is at least equal to L/2, the mechanical-stress-application device and at least one part of the lock to be treated being received in a microwave-proof chamber.

8. The process as claimed in claim 7, wherein the application of the mechanical stress is carried out with a curler, the antenna being helical and placed inside the curler.

* * * * *